United States Patent [19]

Durual et al.

[11] Patent Number: 4,853,141

[45] Date of Patent: Aug. 1, 1989

[54] POLYFLUORINATED AMINO ALCOHOLS AND THEIR ESTERS, PREPARATION OF THESE COMPOUNDS AND THEIR USE AS LUBRICANT ADDITIVES

[75] Inventors: Pierre Durual, Vernaison; Marc Hermant, Cormeilles-en-Parisis; Charles Laviron, Lyons, all of France

[73] Assignee: Societe ATOCHEM, Puteaux, France

[21] Appl. No.: 205,207

[22] Filed: Jun. 10, 1988

[30] Foreign Application Priority Data

Jun. 19, 1987 [FR] France ..... 87 08662

[51] Int. Cl.[4] ..... C10M 133/04

[52] U.S. Cl. ..... 252/51; 252/58; 564/355; 564/366; 564/503; 564/510

[58] Field of Search ..... 252/51, 58; 564/503, 564/510, 355, 366

[56] References Cited

U.S. PATENT DOCUMENTS 3,873,619 3/1975 Luca et al. ..... 564/503
4,059,629 11/1977 Smith .

FOREIGN PATENT DOCUMENTS

WO83/02622 6/1983 PCT Int'l Appl. .
2125063A 2/1984 United Kingdom .

*Primary Examiner*—Jacqueline V. Howard

*Attorney, Agent, or Firm*—Stevens, Davis, Miller & Mosher

[57] ABSTRACT

The invention relates to new polyfluorinated compounds which are usable as anti-wear additives for lubricants.

These compounds are of general formula:

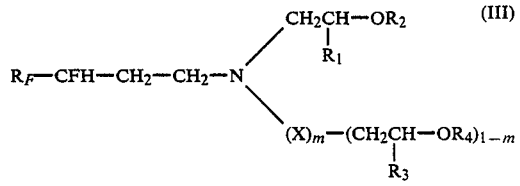

(III)

in which $R_F$ is a perfluoroalkyl radical, $R_1$ and $R_3$ each denote a hydrogen atom or an alkyl, cycloalkyl or aryl radical, $R_2$ and $R_4$ each denote a hydrogen atom or an acyl residue, m equals 0 or 1 and X denotes a hydrogen atom or a 2-hydroxy-1-phenylethyl group. They are prepared by hydrogenation of amino alcohols of formula:

$$R_F—CF{=}CH—CH_2—NH—CH_2CH(R_1)—OH$$

followed, where appropriate, by a reaction with an epoxide and/or an esterification.

12 Claims, No Drawings

POLYFLUORINATED AMINO ALCOHOLS AND THEIR ESTERS, PREPARATION OF THESE COMPOUNDS AND THEIR USE AS LUBRICANT ADDITIVES

FIELD OF THE INVENTION

The present invention relates to fluorinated products and lubricants. More especially, the field of the invention relates to new polyfluorinated compounds which are usable as anti-wear additives for lubricants.

BACKGROUND OF THE INVENTION

The application of certain organofluorine derivatives as additives to lubricant compositions is known. For example, the use of salts of aliphatic amines and perhalogenated monocarboxylic acids has been described in U.S. Pat. No. 3,565,926. Similarly, the use of the derivatives obtained by the reaction of an aromatic amine and a fluorinated organic compound chosen from fluorinated monocarboxylic acids has been disclosed in French Pat. No. 2,026,493. However, these carboxylic derivatives have the disadvantage of losing their anti-wear efficacy in the presence of traditional additives such as dispersant-detergent additives. This disadvantage is the result of either physiochemical interactions, which prevent their absorption at the surfaces to be lubricated, or of chemical interactions, especially when the dispersant-detergent additives are neutral or over-based salts of alkaline earth metals.

According to French Pat. No. 2,520,377, lubricant compositions possessing exceptional anti-wear properties and an exceptional friction-reducing power have been obtained using, as an organofluorine additive, amines or amino alcohols containing a polyfluorinated chain, and more especially amino alcohols which can be represented by the formula:

$$C_nF_{2n+1}C_2H_4-\underset{\underset{R}{|}}{N}-C_2H_4OH \qquad (I)$$

where n is an integer between 2 and 20 and R is a hydrogen atom or a hydroxyethyl radical. As stated on page 4 of that patent, these amino alcohols, obtained by condensing a 2-(perfluoroalkyl) ethyl iodide with ethanolamine or diethanolamine, occur industrially in the form of mixtures containing a not insignificant proportion (most often from 30 to 50% by weight) of unsaturated amino alcohols of formula:

$$C_{n-1}F_{2n-1}CF{=}CHCH_2-\underset{\underset{R}{|}}{N}-C_2H_4OH \qquad (II)$$

which it is not economical to separate. These unsaturated amino alcohols are also obtained by reacting an olefin $C_nF_{2n+}1-CH=CH_2$ with an amino alcohol $R-NH-CH_2CH_2OH$ (U.S. Pat. No. 3,535,381).

The preceding references are hereby incorporated by reference.

It is now been found that the fluorinated products obtained by hydrogenation of the compounds of the formula (II) or of the industrial mixtures containing them show substantially improved anti-wear efficacy. It has also been found that the derivatives obtained by reaction of the hydrogenated products with an epoxide and/or esterification of these products also, for their part, show an excellent anti-wear efficacy.

SUMMARY OF THE INVENTION

The subject of the present invention is hence the polyfluorinated compounds of general formula:

$$R_F-CFH-CH_2-CH_2-N\begin{cases} CH_2\overset{\overset{R_1}{|}}{C}H-OR_2 \\ (X)_m-(CH_2\underset{\underset{R_3}{|}}{C}H-OR_4)_{1-m} \end{cases} \qquad (III)$$

and the mixtures thereof with one another and/or with up to approximately 80% of polyfluorinated compounds of formula:

$$R_F-Y-CH_2-CH_2-N\begin{cases} CH_2\overset{\overset{R_1}{|}}{C}H-OR_2 \\ (X)_m-(CH_2\underset{\underset{R_3}{|}}{C}H-OR_4)_{1-m} \end{cases} \qquad (IV)$$

in which formulae:

- $R_F$ denotes a linear of branched perfluoroalkyl radical containing from 1 to 19 carbon atoms, and preferably from 5 to 15,
- $R_1$ and $R_3$ which may be identical or different, each denote a hydrogen atom, an alkyl radical containing from 1 to 20 carbon atoms, a cycloalkyl radical containing 5 to 6 carbon atoms or an optionally substituted aryl radical,
- $R_2$ and $R_4$ which may be identical or different, each denote a hydrogen atom or the acyl residue of an aliphatic, cycloaliphatic or aromatic carboxylic acid,
- m equals zero or one,
- X denotes a hydrogen atom or a 2-hydroxy-1-phenylethyl group, and
- Y denotes a $CF_2$ or $CH_2$ radical.

The compounds and mixtures according to the invention may be prepared from amino alcohols of formula:

$$R_F-CF{=}CH-CH_2-NH-CH_2\underset{\underset{R_1}{|}}{C}H-OH \qquad (V)$$

or from mixtures of these amino alcohols with one another and/or with up to approximately 70% of saturated amino alcohols of formula:

$$R_F-CF_2-CH_2CH_2-NH-CH_2\underset{\underset{R_1}{|}}{C}H-OH \qquad (IV\text{-}a)$$

by hydrogenation followed, where appropriate, by reaction with an epoxide and/or esterification.

DETAILED DESCRIPTION OF THE INVENTION

The hydrogenation which leads to the polyfluorinated compounds of formula:

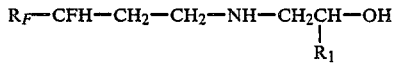

(III-a)

(formula III with m=1 and X=R2=H) or to the mixtures of these compounds III-a with the amino alcohols of formula:

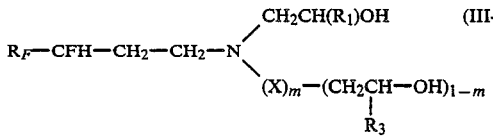

(III-b)

may be performed according to known methods of hydrogenation, using a catalyst chosen from group VIII metals of the Periodic Table and their oxides, preferably palladium on charcoal or Raney nickel. It is possible to work in the presence or absence of a solvent, under a hydrogen pressure ranging from atmospheric pressure to 200 bars (preferably between 5 and 100 bars) and at a temperature which can range from 25° to 250° C. (preferably between 50° and 150° C.). To facilitate the recovery of the catalyst, it is advantageous to work in a solvent, preferably an alcohol and more especially methanol or ethanol, whose boiling points facilitate their removal.

It is possible to obtain the fluorinated compounds of formula:

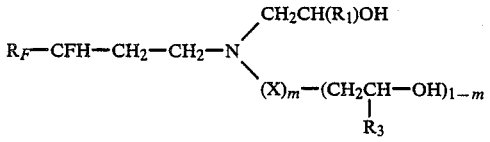

(III-b)

(formula III with m=0 or 1 and X=2-hydroxy-1-phenyl-ethyl) and the mixtures thereof with the aminodiols of formula:

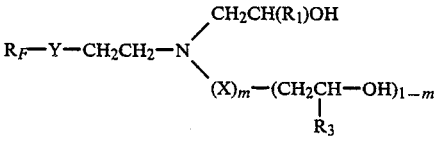

(IV-c)

by reacting an epoxide with the amino alcohols III-a or with the mixtures of amino alcohols III-a +IV-b.

As non-limiting examples of epoxides, ethylene oxide, propylene oxide, 1,2-epoxybutane, 1,2-epoxyhexane, 1,2-epoxydodecane, 1,2-epoxyoctadene and styrene oxide may be mentioned more especially. The reaction with an epoxide may be carried out in different ways, according to the nature of the epoxide used. If an epoxide that is normally gaseous is used, it is preferable to work by bubbling or in an autoclave, whereas, with a liquid epoxide, it is possible to work by simply heating a mixture of the epoxide and the amino alcohol or alcohols.

The products according to the invention in which $R_2$ and/or $R_4$ denote an acyl residue may be prepared by esterification of the aminodiols III-b (or mixtures of III-b+IV-c), by means of a carboxylic acid or of a derivative of formula:

(VI)

where Z denotes an OH group, a chlorine atom or an alkoxy group containing from 1 to 5 carbon atoms, and R denotes a saturated or unsaturated, linear or branched aliphatic radical containing from 1 to 30, and preferably from 4 to 22, carbon atoms, a cycloaliphatic radical or an aromatic radical. This reaction may be carried out at between 0° and 100° C.

When an acid (Z=OH) is used, the reaction is performed in the presence of a water-trapping agent such as sulphuric acid or a molecular sieve. The water formed can be removed by azeotropic distillation using an inert solvent, preferably an aromatic solvent such as, for example, benzene, toluene or xylene.

If a carboxylic acid ester (Z=alkoxy) is used, the reaction is performed in the presence of a transesterification catalyst, for example sulphuric acid, ptoluenesulphonic acid or an aluminum alcoholate. It is possible to use the ester R COZ in excess as a reaction solvent.

When the esterification is performed using an acid chloride (Z=CL), the reaction is performed in the presence of a hydracid-trapping agent, such as tertiary amines containing 3 to 20 carbon atoms and preferably chosen from trimethylamine, triethylamine, tripropylamine, tributylamine, tripentylamine and pyridine. This type of esterification is generally carried out in a solvent comprising of an aliphatic ether (ethyl, propyl, isopropyl, butyl, isobutyl, or amyl ether, methyl tert-butyl ether, methyl tert-amyl ether) or a halogenated aliphatic hydrocarbon such as, for example, methylene chloride and chloroform.

As examples of acid chlorides which are usable, butyryl, caproyl, caprylyl, isovaleryl, lauroyl, linoleyl, heptanoyl, oleyl, palmitoyl, pelargonyl, phenylacetyl, pivaloyl, stearoyl, undecenoyl, benzoyl, 2-methylbenzoyl, 4-tertbutylbenzoyl and cinnamoyl chlorides may be mentioned especially.

Among the polyfluorinated products according to the invention, most special preference is given to those in which:

m equals 1 and $R_1$ and $R_2$ are hydrogen atoms;

m equals 0, $R_1$, $R_2$ and $R_4$ are hydrogen atoms and $R_3$ is an ethyl radical; or m equals 0, $R_1$, $R_2$ and $R_3$ are hydrogen atoms and $R_4$ is a benzoyl radical.

The quantity of perfluorinated product according to the invention to be added to a lubricating oil to obtain an anti-wear efficacy is at least 0.01% based on the weight of the oil, and is preferably between 0.2 and 0.5%.

The lubricating oil can be a mineral oil, a synthetic hydrocarbon or a synthetic oil belonging to the following different families: glycols, glycol ethers, glycol esters, polyoxyalkylene glycols, their ethers and their esters, and esters of monocarboxylic or polycarboxylic acids and monohydric or polyhydric alcohols. This list is not limiting.

When petroleum cuts intended for the manufacture of engine oils, such as "Neutral Solvent" bases, are used as lubricant bases, the organofluorine derivatives of the invention are advantageously combined with traditional dispersant-detergent additives such as calcium or barium alkylphenates and alkylarylsulphonates, or "ashless" dispersants such as succinic derivatives. The dispersant-detergent additives promote the solubilization of the fluorinated additives in the oil without impairing the anti-wear properties of the latter additives and without losing their own power.

The addition of fluorinated derivatives according to the invention to formulated oils already containing additives such as zinc alkyldithiophosphates brings about a substantial improvement in the anti-wear power and an increase in the load-carrying ability of these oils. This occurs without interfering with the properties conferred by the other additives: dispersivity, detergency, anti-corrosion power, for example.

The replacement of all or part of the zinc dithiophosphate used as an anti-wear additive in oil formulations for internal-combustion engines or for hydraulic power transmitters by 0.02 to 0.2% of organofluorine compounds according to the invention makes it possible to achieve a level of protection against wear which is equal to or greater than that obtained with this traditional additive.

The fluorinated additives according to the invention may be used either as a replacement for zinc alkyldithiophosphates in lubricating oils for petrol or diesel engines or for hydraulic power transmitters or an extra additive in these oils.

EXAMPLES

The examples and tests which follow illustrates the invention without limiting it. The percentages are understood to be by weight, except where otherwise stated.

EXAMPLE 1 a. A 4-liter reactor equipped with a stirrer, a condenser and a thermometer is charged with 1,410g or 95% pure (perfluorooctyl)ethylene $C_8F_{17}—CH=CH_2$, 0.96 liter of n-pentanol, 252g of sodium bicarbonate and 732g of monoethanolamine. The mixture is then heated to reflux (117° to 121° C.) for 7 hours.

The chestnut-colored mixture is then cooled to 35°-40° C., and thereafter washed 5 times with 1.5 liters of water at 35°-40° C. The organic phase thereby obtained (2,155g) is then topped in a film evaporator at 85° C., under 667 Pa, at the rate of 0.42 l/h, to remove the residual water, a part of the n-pentanol and the unreacted (perfluorooctyl)ethylene. 1,306g of a mixture containing 78.5% of fluorinated product and 21.5% of n-pentanol are thereby obtained.

This mixture is then topped at 50° C. on a distillation column under 1,333 Pa. The tail product (1,242g) is distilled in a film evaporator at 167° C. under 67 to 133 Pa, at the rate of 0.15 l/h. 1,180g of a yellow oil are thereby collected as the top product, whose molar composition, determined by NMR, is as follows:

$C_7F_{15}—CF=CH—CH_2—NH—CH_2CH_2OH$ : 88.5%

$C_8F_{17}—CH_2CH_2—NH—CH_2CH_2OH$ : 11.5% b. A 2 liter stainless steel autoclave equipped with a magnetically driven stirring system is charged with 1,000g of the oil obtained above, 0.6 liter of 99% pure ethanol and 16g of an approximately 60% strength suspension of Raney nickel in 99% pure ethanol, and 3 purges are then performed with nitrogen under 20 bars and then 3 purges with hydrogen under 20 bars. The mixture is then hydrogenated for 12 hours at 70°-75° C., stirring at 1,500 r.p.m. and maintaining the hydrogen pressure at between 8 and 11 bars.

After the autoclave has been cooled and purged, the catalyst is filtered off and the ethanol removed by distillation. 1,025g of a pale yellow waxy solid is thereby obtained. The GC analysis of which yields the following molar composition:

$C_7F_{15}—CFH—CH_2CH_2—NH—CH_2CH_2OH$ : 64.1%

$C_7F_{15}—CH_2CH_2CH_2—NH—CH_2CH_2OH$ : 24.9%

$C_8F_{17}—CH_2CH_2—NH—CH_2CH_2OH$ : 11%

By purification on a silica column, the main product:

$C_7F_{15}—CFH—CH_2CH_2—NH—NH—CH_2CH_2OH$ is isolated, which product has the following characteristics:

Melting point: 54°-55° C.
Boiling point: 260° C. under $10^5$ Pa
$^{13}$CNMR ($CDCl_3$, TMS): δ(ppm)
—CFH—: 86.9
—$CH_2OH$: 60.7
—$CH_2CH_2OH$: 51.0
—$CH_2$—NH—: 44.0
—CFH—$CH_2$—: 27.6

EXAMPLE 2

25.35g of the waxy solid obtained in Example 1-b and 4.45g of 1,2-epoxybutane are placed in a 0.1-liter Erlenmeyer surmounted by a condenser and stirred with a bar magnet. The mixture is then heated with stirring for 18 hours at 65° C.

The excess epoxide is then permitted to evaporate off at 65° C. at atmospheric pressure, after which the final traces are removed under vacuum. 28g of a brown liquid are thereby obtained, consisting of the following diols:

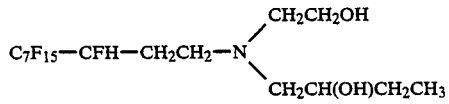

64.1 mol %

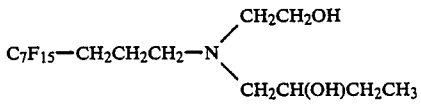

24.9 mol %

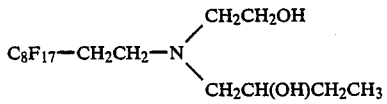

11 mol %

The $^{13}$CNMR ($CDCl_3$) characteristics of the main diol are as follows:

δ(ppm)
—CH(OH)—: 69.6
—$CH_2$CH(OH)—: 60.4
—$CH_2OH$: 59.3
—$CH_2CH_2OH$: 56.1
—$CH_2$—N: 46.2
—CFH—$CH_2$—: 28.2
—$CH_2$—$CH_3$: 27.5
—$CH_3$: 9.6

EXAMPLE 3

150g of the waxy solid obtained in Example 1-b and 36.6g of epoxystyrene are placed in a 0.25-liter reactor equipped with a stirrer, a thermometer and a condenser. The mixture is then heated for 6 hours to 110° C.

171g of a chestnut-colored oil are thereby obtained, the main constituents of which have the following $^{13}$CNMR ($CDCl_3$) characteristics:

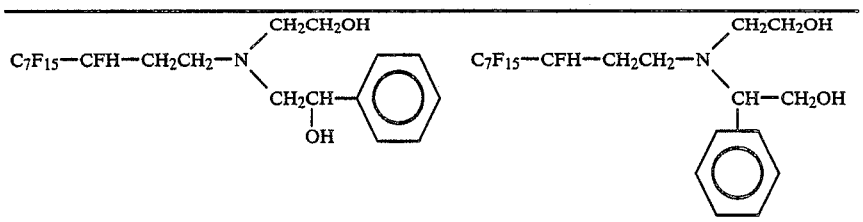

| | δ (ppm) | | δ (ppm) |
|---|---|---|---|
| $C_6$ ring | 142.1 - 127.4 - 127.2 and 125 | $C_6$ ring | 142 - 127.4 - 127.2 and 125 |
| $-\underline{C}H(OH)-$ | 70.1 | $-\underline{C}H-\phi$ | 65.9 |
| $-\underline{C}H_2-CH(OH)$ | 62.4 | | 60.9 |
| | | $>CH-\underline{C}H_2OH$ | |
| $-\underline{C}H_2OH$ | 58.6 | $-CH_2-\underline{C}H_2OH$ | 58.3 |
| $-\underline{C}H_2CH_2OH$ | 55.7 | $-\underline{C}H_2CH_2OH$ | 55.7 |
| | 45.4 | | 43.2 |
| $-\underline{C}H_2-N<$ | | $-\underline{C}H_2-N<$ | |
| $-CFH-\underline{C}H_2-$ | 27.8 | $-CFH-\underline{C}H_2-$ | 29.3 |

EXAMPLE 4 a. A 4-liter stainless steel autoclave equipped with a magnetically driven stirring system is charged with 2,000g of a mixture of fluorinated amino alcohols $C_8F_{17}-CH_2CH_2-NH-CH_2CH_2-OH$ (67 mol %) and $C_7F_{15}-CF=CH-CH_2-NH-CH_2CH_2OH$ (33 mol %), followed by 1.2 liters of 99% pure ethanol and 32g of an approximately 60% strength suspension of Raney nickel in 99% pure ethanol. The autoclave is then purged 3 times with nitrogen under 30 bars, and thereafter 3 times with hydrogen under 30 bars.

The mixture is then hydrogenated for 6 hours 45 minutes at 70° C., stirring at 2,000 r.p.m. and maintaining the pressure at 20 bars. After the autoclave is cool, the pressure is released and the autoclave is purged. The catalyst is filtered off and the ethanol evaporated off.

1,940g of a pale yellow solid, melting point 51° C., are thereby obtained. The GC analysis of which gives the following composition:

$C_8F_{17}-CH_2CH_2-NH-CH_2CH_2OH$: 65.6%

$C_7F_{15}-CFH-CH_2CH_2-NH-CH_2CH_2OH$: 25.4%

$C_7F_{15}-CH_2CH_2CH_2-NH-CH_2CH_2OH$: 8.9% b. Working under the same conditions as above, but at 150° C., the hydrogenation took only one hour and similar results are obtained.

c. Working in a 0.2-liter autoclave and on 115g of the same mixture of fluorinated amino alcohols, without a solvent, in the presence of 0.5g of catalyst containing 5% of palladium on charcoal, the hydrogenation is carried out in 4 hours under 5 bars at 50° C. Identical results are obtained.

d. If, in the same autoclave, the reaction is performed on the same quantities of amino alcohols and of palladium catalyst, but in the presence of 75g of ethanol as solvent, the hydrogenation is carried out in one hour under 50 bars. The temperature varies from 55° to 65° C. The results are still identical. This is also the case when ethanol is replaced by methanol.

EXAMPLE 5

Working as in Example 4-a, 2,000g of an industrial mixture of fluorinated amino alcohols of formulae:

$C_nF_{2n+1}-CH_2CH_2-NH-CH_2CH_2OH$ (67 mol %)

$C_{n-1}F_{2n-1}-CF=CH-CH_2-NH-CH_2CH_2OH$ (33 mol %)

in which the distribution by weight of the fluorinated chains is as follows:

| n | % |
|---|---|
| 6 | 55.7 |
| 8 | 27.2 |
| 10 | 10.15 |
| 12 | 3.9 |
| ≧14 | 2.9 |

are hydrogenated for 9 hours at 80° C.

After the catalyst is filtered off and the ethanol evaporated off, 1,990g of a semi-liquid, semi-solid pale yellow product (completely liquid at 45° C.) are obtained. The GC analysis of which gives the following results:

$C_nF_{2n+1}-CH_2CH_2-NH-CH_2CH_2OH$: 69.3%

$C_{n-1}F_{2n-1}$—CFH—$CH_2CH_2NH$—$CH_2CH_2OH$: 18.6%

$C_{n-1}F_{2n-1}$—$CH_2CH_2CH_2$—NH—$CH_2CH_2OH$: 9.8%

EXAMPLE 6

A 2-liter reactor equipped with stirrer, a thermometer and a condenser is charged with 1,200g of the product obtained in Example 5 and 309g of styrene oxide. The mixture is then heated with stirring to 118° C., and the heating thereafter stopped. The temperature then rises by itself to 125° C. in the course of 5 minutes. The mixture is cooled to 108° C. in the course of 15 minutes. Heating is then resumed, and the mixture is maintained at 118°-120° C. for a further 2 and a quarter hours.

4.8g of styrene oxide are then added, and the mixture is heated to 110°-115° C. for a further 3 hours. 1,508g of an orange-yellow viscous product are thereby obtained. The GC analysis of which shows that it contains only 0.05% of free styrene oxide.

EXAMPLE 7 a. 1,250g of the product obtained in Example 5 are placed in a 2-liter reactor equipped with a gas inlet with a dipping tube preceded by a bubble counter, a stirring system, a thermometer and a gas outlet with a bubble counter. The mixture is then heated with stirring to 58° C., and the gas line is flushed with nitrogen.

Ethylene oxide is then introduced at such a rate that only slight bubbling is observed in the outlet bubble counter. 189g of ethylene oxide are thereby introduced in the course of 11 and a quarter hours. The temperature is maintained at 60° C.

After the reactor has been cooled, 1,402g of a mixture of fluorinated diols are collected in the form of a yellow oil with pale yellow solid (completely liquid at 45°-50° C.). GC analysis shows that this product contains no monohydric alcohols.

b. A 10-liter round-bottomed flask equipped with a condenser, a dropping funnel, a thermometer and a stirrer, and cooled in an ice bath, is charged with 940g of the mixture of diols obtained above, 197g of triethylamine and 4.5 liters of diisopropyl ether.

With stirring established at 200 r.p.m., a solution of 260g of benzoyl chloride in 360ml of diisopropyl ether is added in the course of 40 minutes while the temperature is maintained at 18°-22° C. When the addition is complete, the dropping funnel is rinsed with 140ml of diisopropyl ether and the ice bath is removed. The mixture is then left with stirring for one hour at room temperature, after which it is heated to 60° C. for 4 hours.

The mixture is then cooled to approximately 30° C., after which the solid (triethylamine hydrochloride) is filtered off and the diisopropyl ether evaporated off. 1,089g of a dark yellow oil are thereby obtained, consisting chiefly of the monobenzoates of the initial fluorinated diols.

ANTI-WEAR TESTS

I. The anti-wear power of lubricant compositions, containing the mineral oil 200 Neutral Solvent as base oil and a fluorinated product according to the invention as additive, is determined using the SHELL EP 4 ball machine. The description of which appears in the "Annual Book of ASTM Standards", Part 24 pages 680 to 688 (1979).

The test consists in rotating a ball 12mm in diameter with a speed of rotation of 1,500 r.p.m. on three other balls held immobile and covered with test lubricant. A load of 40 or 70 daN is applied by a lever system, which pushes the three fixed balls towards the upper ball placed in a chuck.

The anti-wear efficacy of a lubricant is determined by the mean value of the diameters of the wear marks on the three fixed balls after one hour's operation.

The following table I collates the results obtained with different fluorinated additives according to the invention, identified in the form Hx, where x corresponds to the number of the example describing the preparation of the fluorinated additive. A second column shows the proportion by weight of fluorinated additive incorporated in the base oil.

By way of comparison, the results obtained with the following non-hydrogenated homologues are also shown:

I1: oil of Example 1-a

I2 : product obtained by reacting 3g of 2-epoxy-butane with 15g of the oil of Example 1-a under the same working conditions as in Example 2

I3: ditto, but replacing epoxybutane by 3.6g of epoxystyrene and heating for 5 hours to 110° C.

I4: mixture of fluorinated amino alcohols used as the starting material in Example 4-a I5: industrial mixture of fluorinated amino alcohols, used as the starting material in Example 5

I6: product obtained by the action of styrene oxide (144.3g) on the mixture I5 (570g) under the same conditions as in Example 6

I7: product obtained by the action of 5.52g of benzoyl chloride on 20.4g of the mixture of diols obtained as in Exmaple 7-a, but starting with the product I5.

TABLE I

| Fluorinated additive | Proportion % by weight | Diameter of mark in mm for an applied load of 40 daN | 70 daN |
|---|---|---|---|
| None (control) | | 1.44 | 2.37 |
| I 1 | 0.05 | 0.85 | 0.90 |
| H 1-b | 0.05 | 0.48 | 0.59 |
| I 2 | 0.1 | 0.76 | 1 |
| H 2 | 0.1 | 0.59 | 0.76 |
| I 3 | 0.1 | 0.71 | 0.96 |
| H 3 | 0.1 | 0.55 | 0.78 |
| I 4 | 0.1 | 0.74 | 0.98 |
| H 4-a | 0.1 | 0.51 | 0.75 |
| I 5 | 0.05 | 0.75 | 0.81 |
| H 5 | 0.05 | 0.55 | 0.66 |
| I 6 | 0.1 | 0.68 | 0.9 |
| H 6 | 0.1 | 0.40 | 0.52 |
| I 7 | 0.1 | 0.66 | 0.8 |
| H 7-b | 0.1 | 0.44 | 0.55 |

Inspection of these results shows that the products H1 to H7 according to the invention exhibit a distinctly improved anti-wear efficacy compared with their homologues I1 to I7, which have not undergone hydrogenation.

II. The fluorinated additive H6 according to the invention is tested comparatively to three anti-wear additives of the zinc dithiophosphate type currently used in hydraulic oils, namely:

DTPZ: zinc dithiophosphate derived from a $C_6$ secondary alcohol

DTPZB: zinc dithiosphosphate derived from a $C_8$ primary alcohol

DTPZ C: zinc dithiosphosphate derived from a mixture of primary and secondary alcohols.

These additives are dissolved at various concentrations in a paraffinic oil 200N. Then each solution is submitted to the wear test using the EP 4 ball machine under a load of 40 daN for 1 and 2 hours. The temperature is maintained at 120° C. during the test.

The following table II collates the results obtained. Their inspection shows that the wear diameter for the additive H6 according to the invention is always less than those corresponding to the zinc dithiophosphates, although the latter are used in concentrations ten times higher.

TABLE II

| ADDITIVE | CONCENTRATION (% by weight) | DIAMETER OF MARK IN MM 1 hour | 2 hours |
|---|---|---|---|
| | NONE (control) | 1.39 | 1.55 |
| | 0.2 | 0.87 | 1.27 |
| DTPZ A | 0.5 | 0.61 | 0.65 |
| | 1 | 0.59 | 0.66 |
| | 0.2 | 1 | 1.12 |
| DTPZ B | 0.5 | 0.92 | 1.01 |
| | 1 | 0.60 | 0.66 |
| | 0.2 | 0.72 | 0.74 |
| DTPZ C | 0.5 | 0.59 | 0.66 |
| | 1 | 0.66 | 0.79 |
| | 0.02 | 0.44 | 0.51 |
| H6 | 0.05 | 0.46 | 0.50 |
| | 0.1 | 0.44 | 0.53 |

III. The fluorinated additive H6 according to the invention are superadded to a commercial hydraulic oil ISO VG 46 at various concentrations. The anti-wear power is tested on the EP 4 ball machine under a load of 40 daN at 120° C. for 1 and 2 hours.

Results are collated in the following Table III.

TABLE III

| CONCENTRATION OF FLUORINATED ADDITIVE H6 (% by weight) | DIAMETER OF MARK IN MM 1 hour | 2 hours |
|---|---|---|
| 0 (control) | 0.62 | 0.72 |
| 0.02 | 0.57 | 0.63 |
| 0.05 | 0.46 | 0.49 |
| 0.1 | 0.46 | 0.49 |

Although the invention has been described in conjunction with specific embodiment, it is evident that many alternatives and variations will be apparent to those skilled in the art in light of the foregoing description. Accordingly, the invention is intended to embrace all of the alternatives and variations that fall within the spirit and scope of the appended claims.

We claim:

1. A Polyfluorinated compound, comprising the general formula:

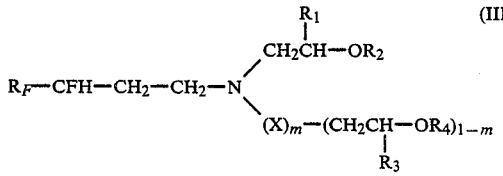

(III)

in which $R_F$ denotes a linear or branched perfluoroalkyl radical containing from 1 to 19 carbon atoms, $R_1$ and which may be identical or different, each denote a hydrogen atom, an alkyl radical containing from 1 to 20 carbon atoms, a cycloalkyl radical containing 5 to 6 carbon atoms or an optionally substituted aryl radical, $R_2$ and $R_4$ which may be identical or different, each denote a hydrogen atom or the acyl residue of an aliphatic, cycloaliphatic or aromatic carboxylic acid, m equals zero or one, X denotes a hydrogen atom or a 2-hydroxy-1-phenylethyl group.

2. The compound according to claim 1, wherein $R_F$ is a linear perfluoroalkyl radical containing from 5 to 15 carbon atoms.

3. The compound according to claim 1, wherein:

m equals 1 and $R_1$ and $R_2$ are hydrogen atoms;

m equals 0, $R_1$, $R_2$ and $R_4$ are hydrogen atoms and $R_3$ is an ethyl radical; or m equals 0, $R_1$, $R_2$ and $R_3$ are hydrogen atoms and $R_4$ is a benzoyl radical.

4. A mixture of compounds according to claim 1, where the groups $R_F$ are different.

5. A mixture of compounds according to claim 1, further comprising up to approximately 80% of one or more compounds of formula:

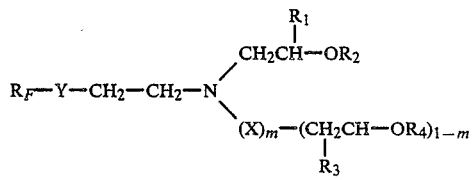

(IV)

in which the symbols $R_F$, m, x, $R_1$, $R_2$, $R_3$ and $R_4$ have the same meanings as in Claim 1 and Y denotes a $CF_2$ or $CH_2$ radical.

6. A process for preparing fluorinated products according to Claim 1, comprising hydrogenating at a temperature ranging from 25° to 250° C. under a hydrogen pressure ranging from atmospheric to 200 bars, an amino alcohol of formula:

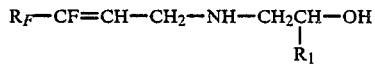

(V)

or a mixture of these amino alcohols with one another and/or with up to approximately 70% of saturated amino alcohols of formula:

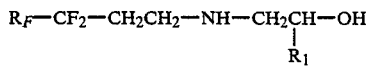

(IV-a)

wherein $R_F$ and $R_1$ have the same meanings as in claim 1, in the presence of a catalyst chosen from metals of group VIII of the periodic Table and their oxides.

7. The process according to Claim 6, further comprising subjecting the product obtained to a reduction at a temperature ranging from 60° to 120° C. with an epoxide and/or to an esterification at a temperature ranging from 0° to 100° C. with an aliphatic, cycloaliphatic or aromatic carboxylic acid or a derviative thereof.

8. A method for improving antiwear properties of a lubricant oil comprising incorporating therein at least one polyfluorinated compound according to claim 1.

9. Lubricants comprising a lubricating oil and a polyfluorinated compound or a mixture of polyfluorinated compounds according to claim 1.

10. Lubricants according to claim 9, wherein the content of polyfluorinated compound is at least 0.01% by weight.

11. Lubricants according to claim 10, wherein the content of polyfluorinated compound(s) is between 0.02 and 0.5% by weight.

12. Lubricants according to claim 9, wherein the polyfluorinated compound or compounds are combined with conventional additives.

* * * * *

UNITED STATES PATENT AND TRADEMARK OFFICE

CERTIFICATE OF CORRECTION

PATENT NO. : 4,853 141

DATED : August 1, 1989

INVENTOR(S) : Pierre Durual Marc Hermant, & Charles Laviron

It is certified that error appears in the above-identified patent and that said Letters Patent is hereby corrected as shown below:

Column 3, lines 10-14; delete formula (III-b) and insert therefor:

$$R_F\text{-}Y\text{-}CH_2CH_2\text{-}NH\text{-}CH_2\text{-}\underset{R_1}{CH}\text{-}OH \qquad \text{(IV-b)}$$

Column 6, starting at line 23; delete:

-CFH-: 86.9
$-CH_2OH$: 60.7
$-CH_2CH_2OH$: 51.0
$-CH_2$-NH-: 44.0
-CFH-$CH_2$-: 27.6 and insert therefor:

-$\underline{C}$FH-: 86.9
-$\underline{C}H_2OH$: 60.7
-$\underline{C}H_2CH_2OH$: 51.0
-$\underline{C}H_2$-NH-: 44.0
-CFH-$\underline{C}H_2$-: 27.6

UNITED STATES PATENT AND TRADEMARK OFFICE

CERTIFICATE OF CORRECTION

PATENT NO. : 4,853,141

DATED : August 1, 1989

INVENTOR(S) : Pierre Durual, Marc Hermant, & Charles Laviron

It is certified that error appears in the above-identified patent and that said Letters Patent is hereby corrected as shown below:

Column 6, starting at line 60; delete:

$-CH(OH)-$: 69.6
$-CH_2CH(OH)-$: 60.4
$-CH_2OH$: 59.3
$-CH_2CH_2OH$: 56.1
$-CH_2-N$: 46.2
$-CFH-CH_2-$: 28.2
$-CH_2-CH_3$: 27.5
$-CH_3$: 9.6 and insert therefor:

$-\underline{C}H(OH)-$: 69.6
$-\underline{C}H_2CH(OH)-$: 60.4
$-\underline{C}H_2OH$: 59.3
$-CH_2CH_2OH$: 56.1
$-\underline{C}H_2-N$: 46.2
$-CFH-\underline{C}H_2-$: 28.2
$-\underline{C}H_2-CH_3$: 27.5
$-\underline{C}H_3$: 9.6

UNITED STATES PATENT AND TRADEMARK OFFICE

CERTIFICATE OF CORRECTION

PATENT NO. : 4,853,141

DATED : August 1, 1989

INVENTOR(S) : Pierre Durual, Marc Hermant, & Charles Laviron

It is certified that error appears in the above-identified patent and that said Letters Patent is hereby corrected as shown below:

Column 10, line 67; delete DTPZ and insert therefor --DTPZ A--.

Column 12, line 3; after "and" insert --$R_3$--;
Line 38; after "$R_3$, m," delete "x" and insert therefor --X--;
Line 64; delete "reduction" and insert therefor --reaction--.

Signed and Sealed this

Second Day of April, 1991

*Attest:*

HARRY F. MANBECK, JR.

*Attesting Officer*

*Commissioner of Patents and Trademarks*